US007416089B2

(12) United States Patent
Kraft et al.

(10) Patent No.: US 7,416,089 B2
(45) Date of Patent: Aug. 26, 2008

(54) HOT-FILL TYPE PLASTIC CONTAINER WITH REINFORCED HEEL

(75) Inventors: Richard G. Kraft, Shorewood, NJ (US); Prasad Joshi, Lockport, IL (US); Phillip Kraft, Alsip, IL (US)

(73) Assignee: Constar International Inc., Philadelphia, PA (US)

( * ) Notice: Subject to any disclaimer, the term of this patent is extended or adjusted under 35 U.S.C. 154(b) by 21 days.

(21) Appl. No.: 11/005,377

(22) Filed: Dec. 6, 2004

(65) Prior Publication Data

US 2006/0118508 A1 Jun. 8, 2006

(51) Int. Cl.
*B65D 1/46* (2006.01)
*B65D 1/02* (2006.01)

(52) U.S. Cl. ..... 215/373; 220/608; 220/609

(58) Field of Classification Search ..... 215/370–373, 215/374; 220/606–609; 2/370–373
See application file for complete search history.

(56) References Cited

U.S. PATENT DOCUMENTS

| | | | | |
|---|---|---|---|---|
| 4,024,975 | A | 5/1977 | Uhlig | |
| 4,108,324 | A | 8/1978 | Krishnakumar et al. | |
| 4,134,510 | A | 1/1979 | Chang | |
| 4,249,666 | A * | 2/1981 | Hubert et al. | 215/373 |
| 4,785,948 | A | 11/1988 | Strassheimer | |
| 4,889,752 | A * | 12/1989 | Beck | 428/36.92 |
| 4,892,205 | A * | 1/1990 | Powers et al. | 215/375 |
| 4,969,563 | A | 11/1990 | Strassheimer | |
| 4,981,736 | A * | 1/1991 | Feddersen et al. | 428/36.92 |
| 4,993,566 | A * | 2/1991 | Eberle | 215/373 |
| 5,038,947 | A | 8/1991 | Strassheimer | |
| 5,198,248 | A | 3/1993 | Krishnakumar et al. | |
| 5,269,437 | A | 12/1993 | Gygax | |
| 5,713,480 | A | 2/1998 | Petre et al. | |
| 5,829,614 | A | 11/1998 | Collette et al. | |
| 6,077,554 | A | 6/2000 | Wiemann et al. | |
| 6,085,924 | A | 7/2000 | Henderson | |
| 6,176,382 | B1 | 1/2001 | Bazlur Rashid | |
| 6,595,380 | B2 | 7/2003 | Silvers | |
| 6,634,517 | B2 | 10/2003 | Cheng et al. | |

(Continued)

FOREIGN PATENT DOCUMENTS

| | | |
|---|---|---|
| EP | 0 225 155 | 6/1987 |

(Continued)

OTHER PUBLICATIONS

UK Examination Report for UK Patent Application No. 0711573.6, mailed Sep. 6, 2007.

*Primary Examiner*—Sue A Weaver
(74) *Attorney, Agent, or Firm*—Wilmer Cutler Pickering Hale & Dorr LLP

(57) ABSTRACT

An improved hot-fill type container that has particular utility for use with the nitrogen dosing hot-fill process includes a finish portion, a main body portion and a base portion having a pushup area and a chime that is situated about the pushup area for supporting the container when a horizontal surface. The container advantageously includes a reinforced heel portion in the area between the main body portion and the chime for protecting the container against deformation that could otherwise be caused by the positive pressurization of the nitrogen dosing process.

10 Claims, 4 Drawing Sheets

U.S. PATENT DOCUMENTS

2001/0002662 A1 6/2001 Rashid

FOREIGN PATENT DOCUMENTS

EP 0 413 924 2/1991
EP 0494098 7/1992
EP 0 668 831 8/1995
JP 2003155015 A * 5/2003

* cited by examiner

HOT-FILL TYPE PLASTIC CONTAINER WITH REINFORCED HEEL

BACKGROUND OF THE INVENTION

1. Field of the Invention

This invention relates generally to the field of manufacturing plastic containers through the blow molding process. More specifically, this invention relates to an improved hot-fill type blow molded plastic container that exhibits improved resistance to deformation as a result of the considerable heat and pressure stress that is applied thereto during and after the nitrogen dosing type hot-fill process, and to processes and materials for manufacturing such a container.

2. Description of the Related Technology

Containers made of biaxially oriented or bioriented polyethylene terephthalate (PET) are in wide use throughout the world for packaging carbonated and non-carbonated beverages and other liquids. Biaxially oriented PET has good mechanical strength, a good appearance, and forms an effective barrier to the gases contained in the liquids and to the oxygen in the air, thus providing good protection against oxidation.

Perishable food and beverage products such as fruit juices are typically filled at elevated temperatures, such as 180 to 190 degrees Fahrenheit, under variable pressure conditions into specially designed PET containers in what is conventionally referred to as the hot-fill process. Container designs that are intended for use with this process are referred to as hot fill type containers. After filling, the containers are sealed by the application of a closure, preventing mass transfer into and out of the container. As the product within the containers cools, the volume that is occupied by the product decreases, thereby inducing a partial vacuum within the container that exerts an inward force upon the sidewall of the container.

The design of hot fill type containers is heavily influenced by the necessity of managing this shrinkage during cooling. Typically, the shrinkage has most commonly been accommodated by molding one or more concave vacuum panel areas into the sidewall of the container that are designed to deflect inwardly as the product cools. By substantially limiting the deformation to the vacuum panel areas, unwanted distortion of other portions of the container is prevented. In the manufacture of such containers, it is often desirable to have relatively more plastic material flow during the molding process to those areas of the container sidewall that are designed to remain rigid, and relatively less to those areas that are designed to flex. An optimal distribution of the plastic material will ensure the desired strength and flexibility characteristics for the container while avoiding waste of material.

One type of hot-fill technology that is currently under development is known as the nitrogen dosing type hot-fill process. The nitrogen dosing type hot-fill process involves injecting a dose of liquid nitrogen into the container during the hot-fill process. The liquid nitrogen gasifies, pressuring the container after application of the closure to an initial elevated pressure, which is typically on the order of about 20-25 psi. As the container cools, this pressure differential between the inside and the outside of the container will reduce itself to a slight internal overpressure. The initial pressurization and subsequent pressure adjustment, in conjunction with the heat that is inherent to the hot-fill process, places a great deal of stress on the walls of the container. Since, unlike the conventional hot-fill process, the pressure is positive, the stress that is placed on the container is different than the stress that is normally applied during a hot-fill procedure in which no nitrogen dosing is used. Conventional container designs that have worked well with the conventional hot-fill process tend to unexpectedly deform and/or fail under the overpressurization that is inherent to the nitrogen dosing process.

Typically, a blow molded PET container includes a threaded finish portion, a neck portion, a main body portion, a base portion that is either a champagne-type base, a footed base or a modified champagne-type base that has some of the characteristics of a footed base, and what is known as a heel portion connecting the main body portion to the base portion. It has been determined by the inventor that the heat and stress applied to the sidewall of the container, and particularly to the heel portion, during the nitrogen dosing hot-fill process is instrumental in causing unwanted permanent deformation of the heel portion and sidewall of the container. In designing such containers, the diameter of the base portion is normally limited to that which is needed to provide a stable contact ring for supporting the container on a flat surface. By minimizing the size of the base portion, material is conserved. At the same time, the diameter of the main body portion needs to be maximized in order to provide the required total container volume. The greater the differential between the sidewall diameter of the main body portion and the outer diameter of the contact ring of the base portion, the steeper the inclination of the heel portion. The inventor has determined that the inclination of the heel portion, and particularly the lower end of the heel portion, is material to the amount of deformation that takes place as a result of the overpressured environment within the container as a result of the nitrogen dosing process.

In forming certain types of plastic containers from a preform, it is known to utilize a preform that has a thickened sidewall portion toward the closed end of the preform in order to provide additional material that is designed to flow into the container base, usually a footed base, during molding. However, this procedure is not known in the manufacture of hot-fill type containers or nitrogen dosing type hot fill containers, which are considered separate technical areas of container manufacturing because of the different design requirements and characteristics of such containers.

A need exists in this area of technology for an improved hot-fill type container that exhibits an improved resistance to deformation during the hot-fill process, and particularly during the nitrogen dosing hot-fill process, as well as for an improved process of manufacturing such a container.

SUMMARY OF THE INVENTION

Accordingly, it is an object of the invention to provide an improved hot-fill type container that exhibits an improved resistance to deformation during the hot-fill process, and particularly during the nitrogen dosing hot-fill process, as well as for an improved process of manufacturing such a container.

In order to achieve the above and other objects of the invention, a plastic hot-fill type container that is constructed according to a first aspect of the invention includes a finish portion; a main body portion; a base portion, the base portion defining a push-up area and a chime oriented about the pushup area for supporting the container on a horizontal surface, the base portion further comprising a generally convex heel portion positioned between the chime and the main body portion, and wherein the heel portion includes a first zone having a first sidewall thickness and a second zone having a second sidewall thickness that is less than the first sidewall thickness.

According to a second aspect of the invention, a plastic hot-fill type container includes a finish portion; a main body portion having an average sidewall thickness; a base portion, the base portion defining a push-up area and a chime oriented about the pushup area for supporting the container on a horizontal surface, the base portion further comprising a generally convex heel portion positioned between the chime and the main body portion, and wherein the heel portion includes a first zone having a first sidewall thickness, the first sidewall thickness being thicker than the average sidewall thickness of the main body portion.

A plastic hot-fill type container according to a third aspect of the invention includes a finish portion; a main body portion; a base portion, the base portion defining a push-up area and a chime oriented about the pushup area for supporting the container on a horizontal surface, the base portion further comprising a generally convex heel portion positioned between the chime and the main body portion, and wherein the heel portion includes a first radiused lower portion having a first radius of curvature, a second radiused upper portion having a second radius of curvature that is greater than the first radius of curvature and a transition area where the first radiused lower portion intersects the second radiused upper portion, and wherein a line intersecting said heel portion at the transition area and intersecting an outermost edge of the chime forms an angle Φ with respect to a longitudinal axis of the container, and wherein the angle Φ is within a range of about 30° to about 42.5°.

According to a fourth aspect of the invention, a plastic hot-fill type container includes a finish portion; a main body portion; a base portion, the base portion defining a push-up area and a chime oriented about the pushup area for supporting the container on a horizontal surface, wherein the push-up area comprises an annular step ring that is segmented into a plurality of bottom steps and a plurality of concave circumferentially extending top steps, the base portion further comprising a generally convex heel portion positioned between the chime and the main body portion, the heel portion including a first radiused lower portion having a first radius of curvature and a second radiused upper portion having a second radius of curvature that is greater than the first radius of curvature; and wherein a line that is tangent to an inwardinost extension of the bottom steps and intersecting an innermost edge of the chime forms an angle β with respect to a longitudinal axis of the container, and wherein the angle β is within a range of about 30° to about 42.5°.

A method of making a hot-fill type plastic container according to a fifth aspect of the invention includes providing a preform having an open end and a closed end, the preform having a first wall portion having a first wall thickness and a second wall portion having a second wall thickness that is thicker than the first wall thickness, the second wall portion being proximate to the closed end; and blow molding the preform into a hot-fill type plastic container of the type including a main body portion, a base portion including a chime, a push-up area and a generally convex heel portion connecting the main body portion to the base portion, and wherein the step of blow molding comprises utilizing material from the second wall portion in forming the generally convex heel portion of said hot-fill type plastic container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
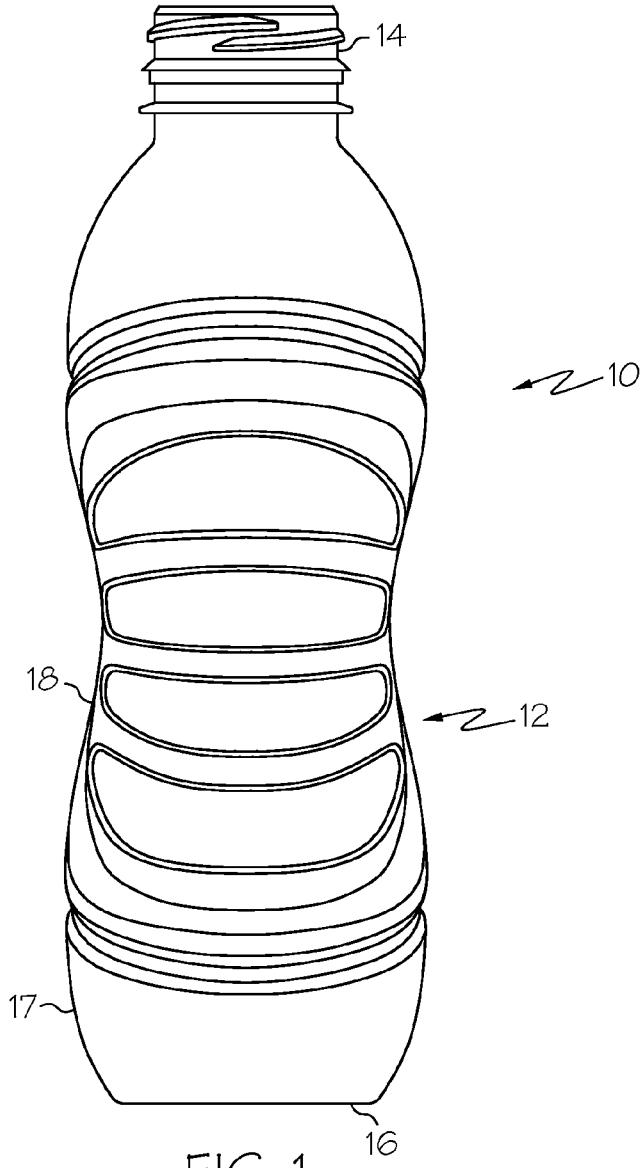
FIG. 1 is a side elevational view of the container that is constructed according to a preferred embodiment of the invention.

Referring now to the drawings, wherein like reference numerals designate corresponding structure throughout the views, and referring in particular to FIG. 1, a molded polymeric hot-fill type container 10 that is constructed according to a preferred embodiment of the invention includes a main body portion 12 having a sidewall 18. Container 10 further includes a threaded finish portion 14 to which a conventional screw type plastic closure can be attached, and a modified champagne type base portion 16 that is connected to main body portion 12 by a generally convex heel portion 17.

With the exception of the details described below in relation to the heel portion 17, base portion 16 is generally identical to the base portion described in U.S. Pat. No. 6,634,517 to Cheng, the disclosure of which is hereby incorporated by reference as if set forth fully herein. It should be noted that the Cheng patent is not directed to hot-fill type containers or nitrogen dosing and the design challenges presented thereby, but rather to pasteurizable plastic beer bottles.

Figure 3:
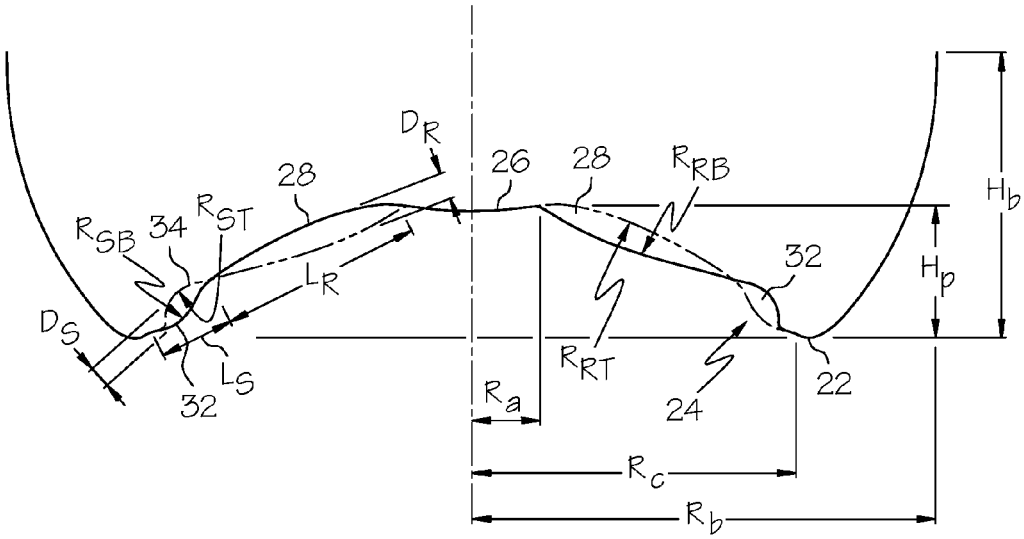
FIG. 3 is a diagrammatical view depicting details and dimensions of a base portion of a container that is constructed according to the preferred embodiment of the invention.
Figure 4:
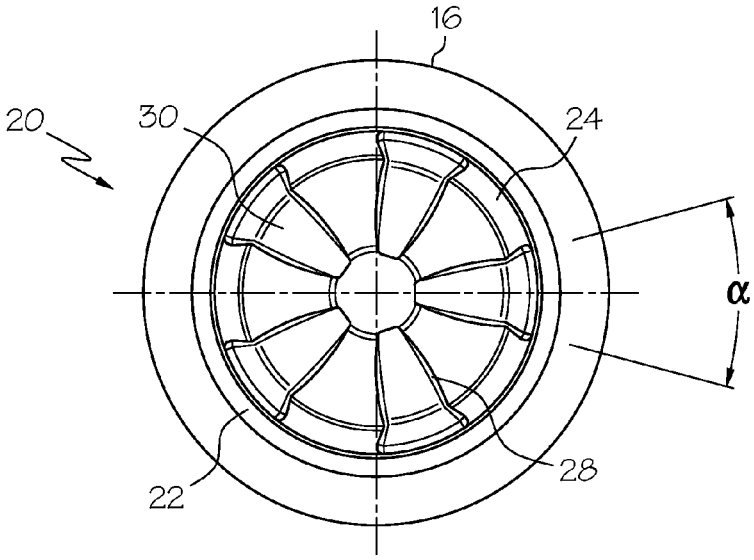
FIG. 4 is a bottom plan view of a container that is constructed according to the preferred embodiment.

As may best be seen in FIGS. 3 and 4, base portion 16 includes a lower end 20 that defines an annular contact ring 22 or chime for supporting the container 10 with respect to an underlying horizontal surface. Base portion 16 further is shaped to include an annular step ring 24 that is defined concentrically immediately radially inwardly and within the annular contact ring 22. Annular step ring 24 has a radial length or thickness $L_S$ within a plane extending from one location at a radial outwardmost boundary of the annular step ring 24 to the closest radially inwardmost location, as is best shown in FIG. 3.

Looking to FIGS. 3 and 4, base portion 16 further includes a central push-up area 26 that is elevated with respect to annular contact ring 22 by a height $H_p$, and that has a radius $R_a$. Push-up area 26 is generally circular in shape, with some deviations, as may best be seen in FIG. 4. The radius $R_a$ is calculated as the radius that defines the largest circle that could fit entirely within the push-up area 26 without contacting another element, such as a rib 30, described in further detail below.

As may best be seen in FIGS. 3 and 4, base portion 16 further is shaped so as to define a generally concave transition region 28 that is interposed between the central push-up area 26 and the annular contact ring 22. Transition region 28 is concavely curved at a median radius $R_{RT}$, as is shown in FIG. 3. It is to be understood that this curvature may vary slightly, either by design or by variations in manufacturing.

A plurality of integrally molded radially extending ribs 30, each having a length $L_R$ and a maximum depth $D_R$, are spaced at regular angular intervals within the concave transition region 28. In the preferred embodiment, each rib 30 has a width that subtends an angle α, which is preferably about 30 degrees. Preferably, the ratio of the length $L_R$ of the radially extending ribs divided by the radial length $L_S$ is within a range of about 1.0 to about 4.0. More preferably, the ratio of the length $L_R$ of the radially extending ribs divided by the radial length $L_S$ is within a range of about 2.5 to about 3.0. Most preferably, this ratio is about 2.7. Preferably, maximum depth $D_R$ is within a range of about 0.05 to about 0.25 of the length $L_R$ of said radially extending ribs, and more preferably within a range of about 0.1 to about 0.18 of the length $L_R$ of said radially extending ribs. Most preferably, maximum depth $D_R$ is about 0.13 of the length $L_R$ of said radially extending ribs.

Looking again to FIGS. 3 and 4, it will be seen that the annular step ring 24 is further segmented into a plurality of bottom steps 32 and a plurality of concave circumferentially extending top steps 34 that alternate with the bottom steps 32 about the periphery of the annular step ring 24. Each of the top steps 34 is in the preferred embodiment substantially aligned radially with one of the ribs 30, and, accordingly, each of the bottom steps 32 is aligned with a portion of the concave transition region 28 that is between two of the ribs 30. As may best be seen in FIGS. 3 and 4, each of the top steps 34 are shaped so as to curve concavely upwardly from a point where the annular step ring 24 borders the annular contact ring 22 and then continues to curve concavely downwardly to the inner boundary of annular step ring 24 with rib 30. Conversely, each of the bottom steps 32 are shaped so as to curve convexly downwardly from the point where the annular step ring 24 borders the annular contact ring 22 and then to continue curving convexly upwardly to the inner boundary of annular step ring 24 with the concave transition region 28. The combination of ribbing and step ring structure has been found to create local stress points along the contact surface or area that significantly enhances the stability of the entire lower portion of the champagne type base portion 16 under pressurization and under external loading. This results in the container that is able to sustain the high pressures and temperatures that are caused by the nitrogen dosing hot-fill process.

As may be seen in FIG. 3, the annular step ring 24 has a depth $D_S$ that is calculated as the distance from the uppermost point of the top step 34 to the lowermost point of the bottom step 32. Preferably, the ratio of this depth $D_S$ to the length $L_S$ of the annular step ring is within a range of about 0.2 to about 0.5. More preferably, this ratio is within a range of about 0.3 to about 0.5, and most preferably is about 0.39. Also, the ratio $R_{RT}/R_{RB}$ of the convex outer radius of the rib 30 divided by the concave inner radius of the transition portion 28 is preferably within a range of about 0.6 to about 1.0. More preferably, this range is about 0.75 to about 0.9, and most preferably the ratio is about 0.82.

Each of the top steps 34 of the annular step ring 24 has a radius of curvature $R_{ST}$, each of the bottom steps 32 similarly have a convex radius of curvature $R_{SB}$. Preferably, a ratio $R_{SB}/R_{ST}$ is within a range of about 0.5 to about 1.0, and more preferably this ratio is within a range of about 0.65 to about 0.85. Most preferably, the ratio is about 0.75. In addition, a ratio $R_a/R_b$ of the radius of the push-up area 26 divided by the radius of the entire base portion 16 is preferably within a range of about 0.15 to about 0.25, and most preferably is about 0.19.

The contact diameter of a champagne type base or a modified champagne type base for a molded plastic container is a major factor in the stability performance of the base both under high-pressure conditions and during filling of the container. With a given radius of contact, it has in the past been very important, but difficult, to design a base having the proper relationship between the push-up height and the overall height of the base. In determining this relationship, attention must be given to the desired material distribution and the contact point and the stress and loading distribution in the entire base. Another particularly advantageous feature of the invention is that a unique and beneficial methodology has been created for determining the optimum relative dimensions of the base portion of a champagne type base for a molded hot-fill type plastic container. Preferably, the optimum relative dimensions are determined and selected substantially according to the formula:

$$Hp = \frac{\left[Hb + 2(Rb - Rc] * \left(\frac{P}{TcRc} - 1\right) * (Rc - Ro)\right.}{2(Rb - Rc)}$$

wherein:

$H_p$ is the height of the central push-up area;

P is a preform index that is equal to the thickness $T_P$ of the preform times the middle radius $R_P$ of the preform;

$H_b$ is the height of the base portion;

$R_b$ is the maximum outer radius of the base portion;

$R_c$ is the radius of the annular contact ring;

$T_c$ is the thickness of molded plastic material in the area of the annular contact ring; and $R_a$ is the radius of the central push-up area.

Moreover, it has been found that this methodology is particularly effective when a ratio $R_c/R_b$ is within a range of about 0.65 to about 0.74, and when $T_c$ is within a range of about 0.06 to about 0.09 inches.

Figure 5:
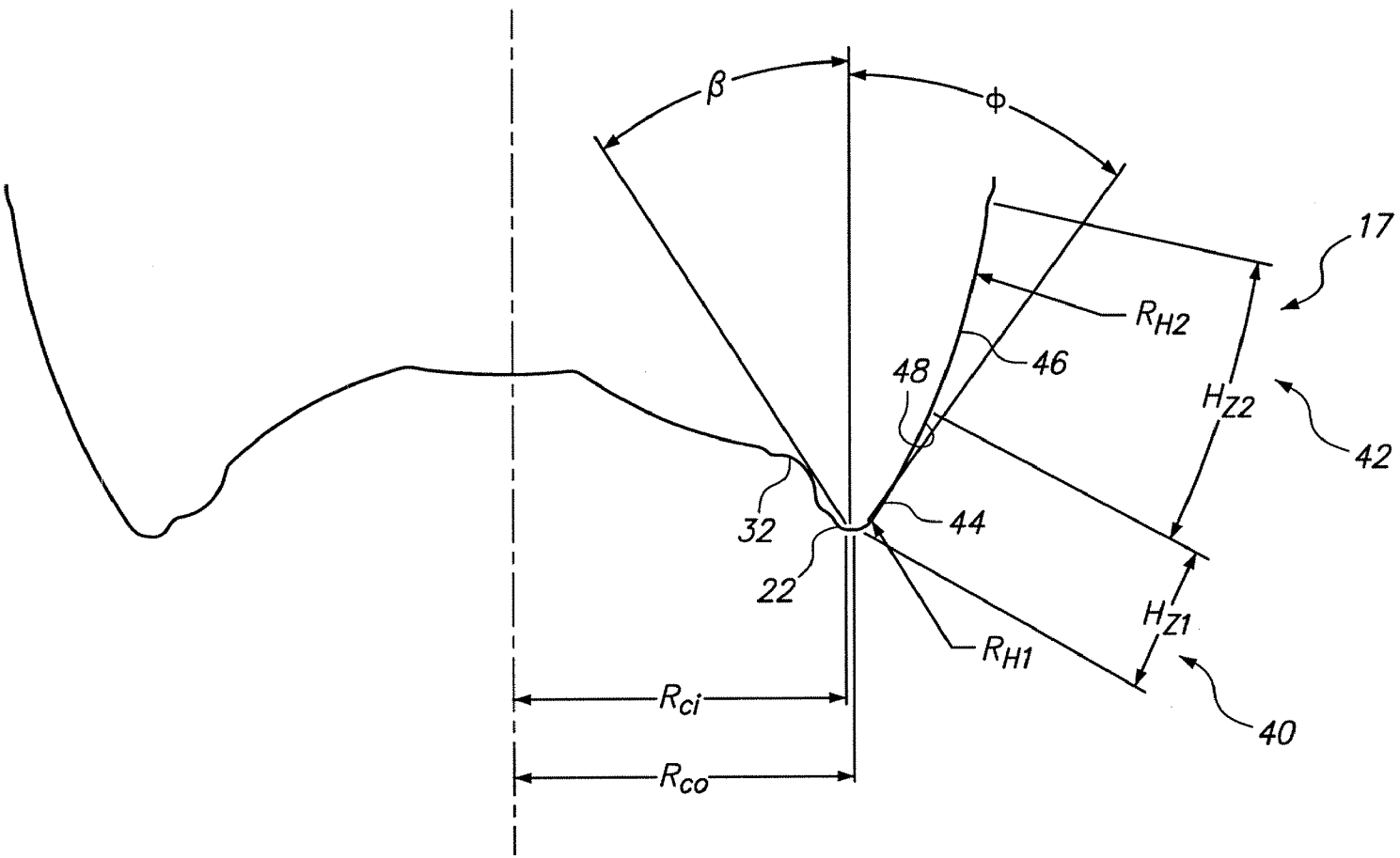
FIG. 5 is a diagrammatical view showing with more detailed features of the base portion of the container depicted in FIG. 3 as well as details of the heel portion of the container that is constructed according to the preferred embodiment of the invention.

Additional details of the preferred construction of the base portion 16, and particularly the heel portion 17 of container 10 are depicted in FIG. 5 and are described below. As FIG. 5 shows, heel portion 17 is generally convex facing outwards and is preferably constructed so as to include a first zone 40 having a first sidewall thickness and a second zone 42 having a second sidewall thickness that is less than the first sidewall thickness. The first sidewall thickness is also preferably thicker than an average thickness of the main body portion 12 of the container 10. First zone 40 preferably includes a lower end of the heel portion 17 that is proximate to the contact ring or chime 22, and preferably extends for a first distance $H_{Z1}$ along the outer surface of the heel portion 17. First distance $H_{Z1}$ is preferably at least 0.15 inches. More preferably, distance $H_{Z1}$ is at least 0.20 inches and yet more preferably at least 0.25 inches. The distance $H_{Z1}$ is preferably considered a minimum distance that first zone 40 extends about the entire circumference of the heel portion 17, although as an alternative embodiment first zone 40 could be constructed so as to extend for irregular distances in order to optimize the structural stability of the heel portion 17 more than one plane or direction than another.

Preferably, the first sidewall thickness is at least 0.025 inches, and more preferably is at least 0.030 inches. The first sidewall thickness could be substantially greater than these values, with prototypes having been tested at thicknesses up to 0.070 inches. The greater the thickness, the more dimensional stability that will be imparted to the heel portion 17, with the trade-off that material costs will increase at greater thicknesses as well.

As is further depicted in FIG. 5, the generally convex heel portion 17 is preferably constructed of at least two radiused portions, including a first radiused lower portion 44 having a first radius $R_{H1}$ and a second radiused upper portion 46 having a second radius $R_{H2}$. The second radius $R_{H2}$ is preferably greater than the first radius $R_{H1}$. A transition area 48 is located where the first radiused lower portion 44 intersects the second radiused upper portion 46. The transition area 48 is preferably smooth and feathered into the respective upper and lower portions 46, 44 so that the transition area 48 will be imperceptible to the casual observer.

As FIG. 5 shows, the contact ring or chime 22 has an innermost edge exhibiting a radius $R_{ci}$ and an outermost edge having a radius $R_{co}$. According to one advantageous aspect of the invention, a line intersecting the heel portion 17 at the transition area 48 and intersecting the outermost edge of the chime or contact ring 22 forms an angle Φ with respect to a longitudinal axis of said container, which is preferably within a range of about 30° to about 42.5°. More preferably, angle Φ is within a range of about 35° to about 40°. It has been found that this angle is important in determining the dimensional stability of the lower part of the container 10 during the overpressurization that is inherent in the nitrogen dosing hot-fill process.

Preferably, first radiused lower portion 44 has a radius of curvature $R_{H1}$ that is preferably within a range of about 0.05 inches to about 0.1 inches, and more preferably within a range of about 0.06 inches to about 0.08 inches. The radius of curvature $R_{H2}$ of the second upper radiused portion 46 is preferably within a range of about 1 inch to about 3 inches, and more preferably within a range of about 1.5 inches to about 2.0 inches.

Additionally, it has been discovered that favorable dimensional stability is more likely to be achieved when a line that is tangent to an inwardmost extension of the bottom step 32 in the pushup region and intersecting the innermost edge of the chime 22 forms an angle β with respect to a longitudinal axis of the container 10, and the angle β is within a range of about 30° to about 42.5°. More preferably, the angle β is within a range of about 35° to about 40°.

Figure 2:
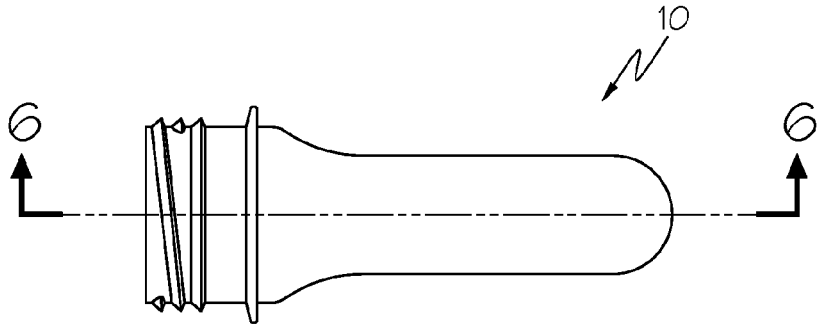
FIG. 2 is a side elevational view of a preform that is used in a method that is performed according to the preferred embodiment of the invention.
Figure 6:
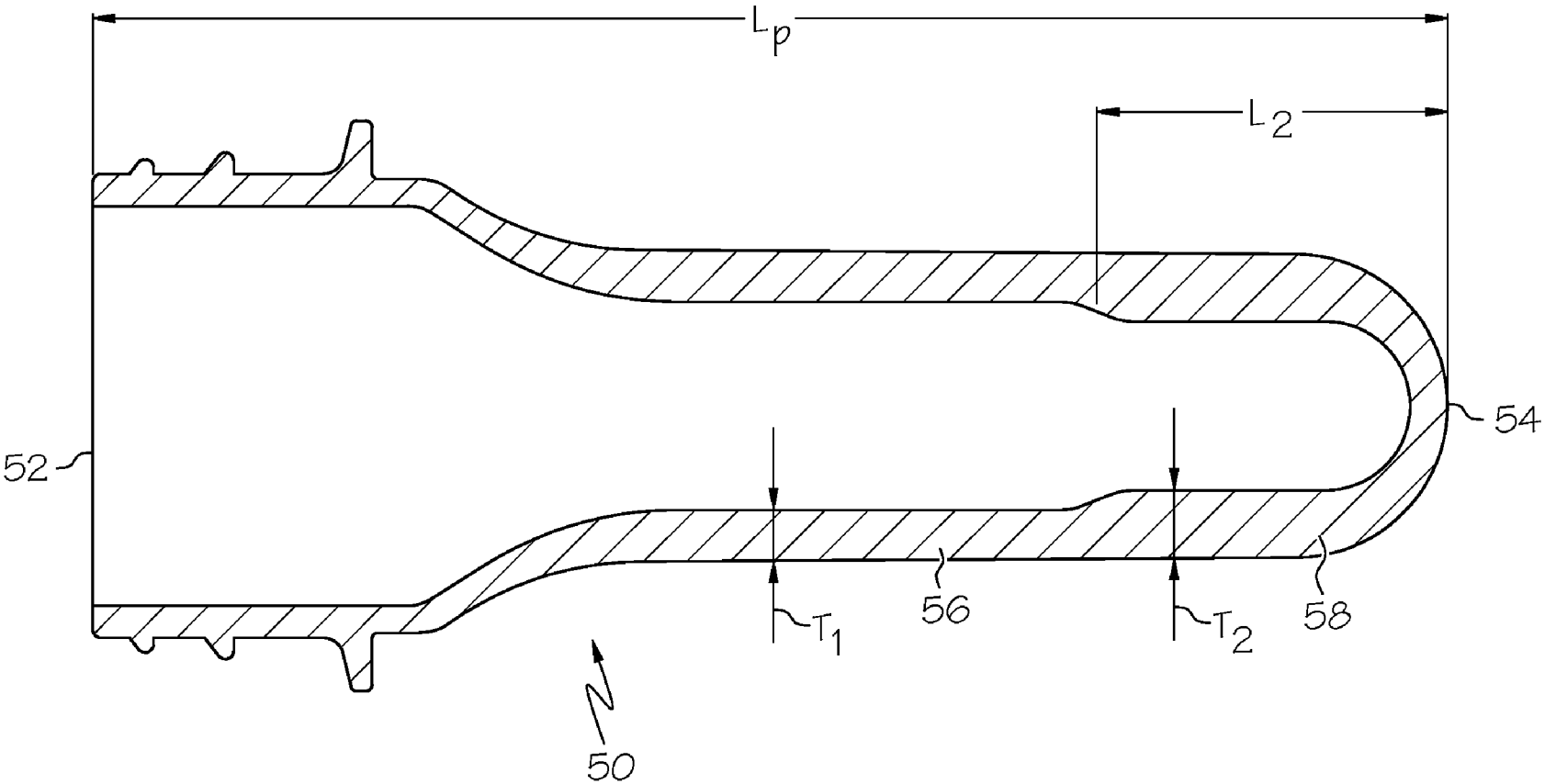
FIG. 6 is a longitudinal sectional view of the preform taken on line 6-6 in FIG. 2.

A method of making a hot-fill type plastic container according to the preferred embodiment of the invention preferably includes a first step of providing a preform 50, best shown in FIGS. 2 and 6, that has a threaded open end 52 and a closed end 54. Preform 50 further preferably has a first wall portion 56 having a first wall thickness $T_1$ and a second wall portion 58 having a second wall thickness $T_2$ that is thicker than the first wall thickness $T_1$. The second wall portion 58 is preferably proximate to the closed end 54 of the preform 50, as is shown in FIG. 6. Preferably, the first wall thickness $T_1$ is within a range of about 0.08 inches to about 0.20 inches, and the second wall thickness $T_2$ is within a range of about 0.15 inches to about 0.25 inches. On a percentage basis, the first wall thickness $T_1$ is within a range of about 40% to about 90% of the second wall thickness $T_2$. The second wall thickness $T_2$ preferably extends for a longitudinal distance $L_2$ that is preferably within a range of about 15% to about 30% of the total overall length $L_P$ of the preform 50.

The preferred method further includes a step of blow molding the preform 50 into a hot-fill type plastic container 10 of the type described above. Preferably and advantageously, the blow molding step is performed so that material from the thickened second wall portion 58 will be used to form the generally convex heel portion 17 of the container 10. More specifically, the material from the thickened second wall portion 58 is intended to facilitate and create the increased wall thickness within the first zone 40 of the heel portion 17.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic hot-fill type container, comprising:

a finish portion;

a main body portion;

a base portion, said base portion defining a push-up area and a chime oriented about said pushup area for supporting said container on a horizontal surface, said base portion comprising a convex heel portion positioned between said chime and said main body portion, and said heel portion comprising a first zone having a first sidewall thickness and a second zone having a second sidewall thickness that is less than said first sidewall thickness, and said first zone including a lower end of said heel portion that is proximate to said chime, wherein said convex heel portion further comprises a first radiused lower portion having a first radius of curvature and a second radiused upper portion having a second radius of curvature that is greater than said first radius of curvature, such that the radius of curvature of said heel portion decreases monotonically along said heel portion from the main body portion to the chime, and further comprises a transition area where said first radiused lower portion intersects said second radiused upper portion, and wherein a line intersecting said heel portion at said transition area and intersecting an outermost edge of said chime forms an angle Φ with respect to a longitudinal axis of said container, and wherein said angle Φ is within a range of about 30° to about 42.5°.

2. A plastic hot-fill type container according to claim 1, wherein said first zone extends for a first distance along an outer surface of said heel portion, and wherein said first distance is at least about 0.15 inches.

3. A plastic hot-fill type container according to claim 2, wherein said first distance is at least about 0.20 inches.

4. A plastic hot-fill type container according to claim 1, wherein said first sidewall thickness is at least 0.025 inches.

5. A plastic hot-fill type container according to claim 4, wherein said first sidewall thickness is at least 0.030 inches.

6. A plastic hot-fill type container according to claim 1, wherein said angle Φ is within a range of about 35° to about 40°.

7. A plastic hot-fill type container according to claim 1, wherein said first radiused lower portion has a radius of curvature that is within a range of about 0.05 inches to about 0.1 inches.

8. A plastic hot-fill type container according to claim 1, wherein said second radiused upper portion has a radius of curvature that is within a range of about 1 inch to about 3 inches.

9. A plastic hot-fill type container according to claim 1, wherein said pushup area comprises an annular step ring that is segmented into a plurality of bottom steps and a plurality of concave circumferentially extending top steps, and wherein a line that is tangent to an inwardmost extension of said bottom steps and intersecting an innermost edge of said chime forms an angle β with respect to a longitudinal axis of said container, and wherein said angle β is within a range of about 30° to about 42.5°.

10. A plastic hot-fill type container according to claim 9, wherein said angle β is within a range of about 35° to about 40°.

* * * * *